US010214960B2

(12) United States Patent
Ng

(10) Patent No.: US 10,214,960 B2
(45) Date of Patent: Feb. 26, 2019

(54) ADJUSTABLE ROLLER BLIND MOUNTING BRACKET WITH BLIND FABRIC PROTECTOR

(71) Applicant: ZMC Metal Coating, Inc., Woodbridge (CA)

(72) Inventor: Philip Ng, Thornhill (CA)

(73) Assignee: ZMC Metal Coating Inc., Woodbridge (CA)

( * ) Notice: Subject to any disclaimer, the term of this patent is extended or adjusted under 35 U.S.C. 154(b) by 0 days.

(21) Appl. No.: 15/710,745

(22) Filed: Sep. 20, 2017

(65) Prior Publication Data

US 2018/0142518 A1 May 24, 2018

Related U.S. Application Data

(60) Provisional application No. 62/426,250, filed on Nov. 24, 2016.

(51) Int. Cl.

| | |
|---|---|
| ***E06B 9/00*** | (2006.01) |
| ***E06B 9/50*** | (2006.01) |
| *A47H 1/12* | (2006.01) |

(52) U.S. Cl.
CPC . *E06B 9/50* (2013.01); *A47H 1/12* (2013.01)

(58) Field of Classification Search
CPC .. E06B 9/42; E06B 9/40; A47H 1/142; A47H 1/14; A47H 1/122; A47H 1/13
USPC ..... 248/251, 252, 254
See application file for complete search history.

(56) References Cited

U.S. PATENT DOCUMENTS

| | | | | |
|---|---|---|---|---|
| 7,427,162 | B2 * | 9/2008 | Kano | C10M 141/10 384/492 |
| 7,854,419 | B2 * | 12/2010 | Ng | E06B 9/50 160/323.1 |
| 8,051,993 | B1 * | 11/2011 | Tu | E06B 9/44 211/123 |
| 8,480,048 | B2 * | 7/2013 | Krantz-Lilienthal | F16B 2/245 160/23.1 |
| 8,967,568 | B2 * | 3/2015 | Wills | E06B 9/50 160/323.1 |
| 9,138,093 | B1 * | 9/2015 | Chou | E06B 9/50 |
| 2014/0299729 | A1 * | 10/2014 | Wills | E06B 9/50 248/254 |

* cited by examiner

*Primary Examiner* — Steven M Marsh
(74) *Attorney, Agent, or Firm* — Merek, Blackmon & Voorhees LLC

(57) ABSTRACT

An adjustable roller blind mounting bracket comprising a bracket member adapted for mounting to a surface, an adjustment plate slidably received upon the interior face of the bracket member, an adjuster to alter the position of the adjustment plate relative to the bracket member; and a shield secured to the adjustment plate and moveable therewith. The adjustment plate releasably receives and supports a roller tube shaft of a roller tube of the roller blind. The shield has an interior side surface offset from the adjustment plate that prevents contact between the adjuster and blind fabric received about the roller tube.

4 Claims, 3 Drawing Sheets

ADJUSTABLE ROLLER BLIND MOUNTING BRACKET WITH BLIND FABRIC PROTECTOR

FIELD

This invention relates generally to the field of brackets used to mount roller blinds and other similar types of window coverings.

BACKGROUND

Roller blinds, or shades as they are sometimes referred to, are common forms of window coverings used in residential and commercial applications. Roller blinds are typically mounted within or exterior to a window frame by means of mounting brackets that are screwed or otherwise fastened to structural elements of the window, the window frame, a wall, or the ceiling adjacent to the window frame.

When mounting a roller blind or shade it is important that the blind be level or horizontal for not only obvious aesthetic purposes, but also to ensure a proper functioning of the blind. If the roller tube upon which the blind fabric is wound is not horizontal, the blind may tend to "telescope" on the roller tube as it is wound up. Excessive telescoping can cause the edge of the blind fabric to come into contact with a mounting bracket, which can result in damage to the blind material, or a binding of the roller tube to the point that the roller blind will not function properly.

It will thus be appreciated that careful and time consuming measurements are often required in order to properly mount a blind or shade. The degree of difficulty in mounting the brackets to hold the shade increases in situations where the existing window, window frame, wall and/or ceiling is not perfectly straight or perfectly plumb.

To assist in the mounting of roller blinds or shades, adjustable mounting brackets have been proposed. Such brackets allow for a degree of vertical movement of the ends of the brackets in order to assist in the horizontal leveling of the roller tube (see for example U.S. Pat. Nos. 7,854,419 and 8,967,568, incorporated herein by reference).

While such adjustable mounting brackets are of assistance in helping to properly orient the roller tube and to help prevent or limit telescoping of the blind fabric, should the blind fabric nevertheless telescope and contact the adjustment mechanisms that are commonly present in such brackets, the edges of the blind fabric could become damaged. The potential for damage to the blind fabric is enhanced in cases where relatively delicate or sheer blind fabrics are utilized.

SUMMARY

There is provided an adjustable roller blind mounting bracket comprising a bracket member adapted for mounting to a surface, said bracket member having an interior face; an adjustment plate slidably received upon said interior face of said bracket member, said adjustment plate releasably receiving and supporting a roller tube shaft of a roller tube of the roller blind; an adjuster to alter the position of said adjustment plate relative to said bracket member; and a shield secured to said adjustment plate and moveable therewith, said shield having an interior side surface offset from said adjustment plate and preventing contact between said adjuster and blind fabric received about the roller tube.

BRIEF DESCRIPTION OF THE DRAWINGS

For a better understanding of the present invention, and to show more clearly how it may be carried into effect, reference will now be made, by way of example, to the accompanying drawings which show exemplary embodiments of the present invention in which.

DESCRIPTION

The present invention may be embodied in a number of different forms. The specification and drawings that follow describe and disclose some of the specific forms of the invention.

Figure 1:
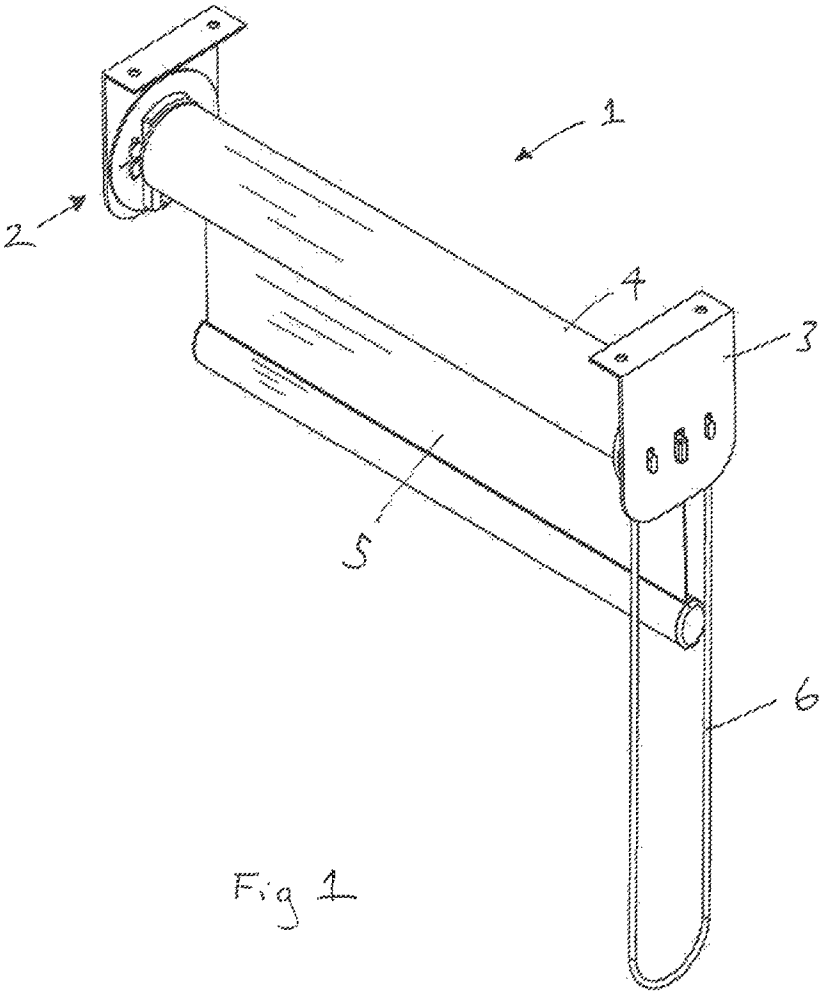
FIG. 1 is a front elevation perspective view of a roller blind employing an adjustable bracket in accordance with an embodiment of the invention.
Figure 4:
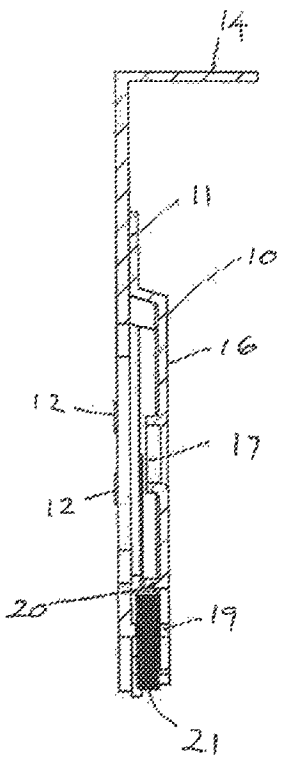
FIG. 4 is a sectional view taken along the line 4-4 in FIG. 3.
Figure 3:
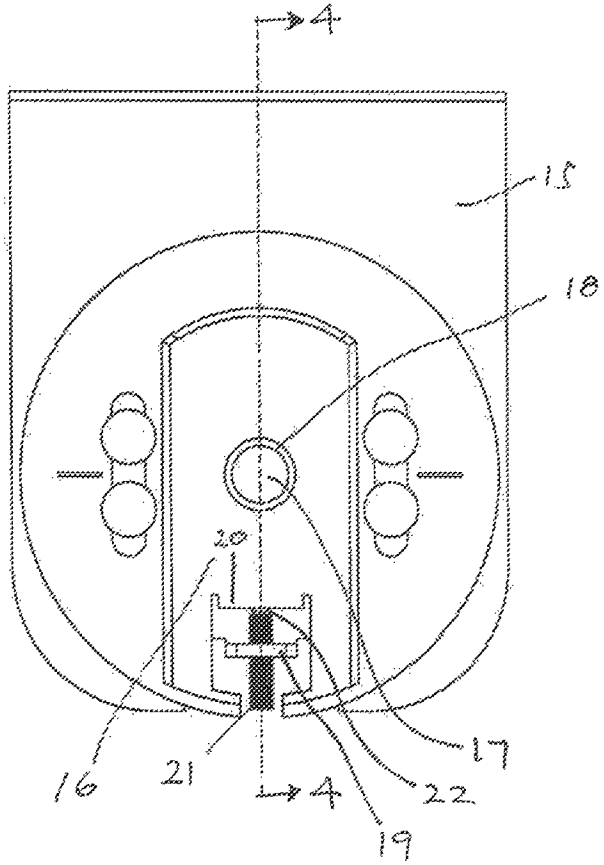
FIG. 3 is a right side view of the mounting bracket shown in FIG. 2.
Figure 2:
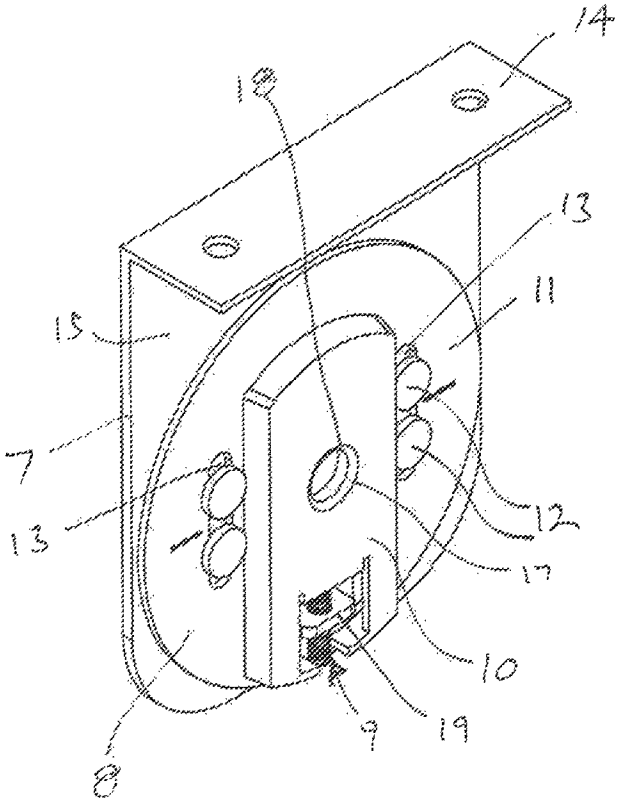
FIG. 2 is an upper side perspective view of an adjustable roller blind mounting bracket in accordance with an embodiment of the invention.
Figure 5:
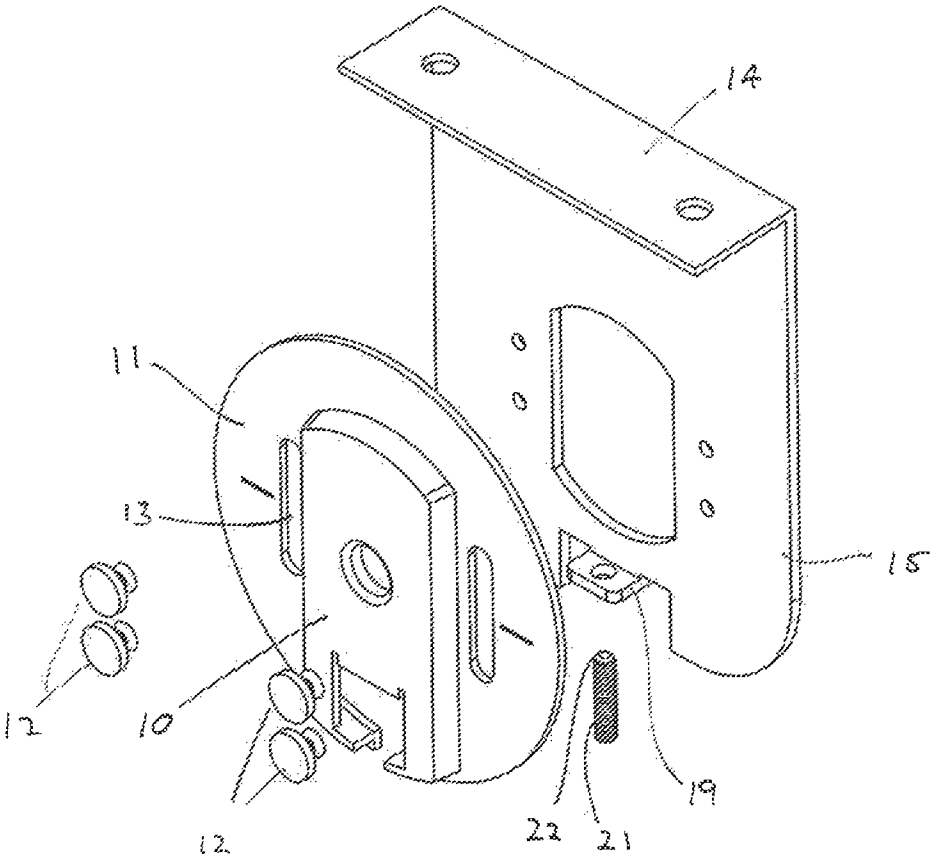
FIG. 5 is an exploded view of the mounting bracket shown in FIG. 2.

FIG. 1 shows a relatively standard roller blind 1 that incorporates an adjustable mounting bracket 2 in accordance with an embodiment of the invention. Roller blind 1 further includes a second mounting bracket 3, with a roller tube 4 secured between the two mounting brackets. Blind fabric 5 is received about roller tube 4. Second mounting bracket 3 would typically include a clutch mechanism (not shown) and a chain or cord 6 for operating the roller blind.

With reference to FIGS. 2 through 5, in accordance with an embodiment of the invention, mounting bracket 2 is comprised, in general, of a bracket member 7, an adjustment plate 8, an adjuster 9, and a shield 10. Although it will be appreciated that a variety of different forms and configurations of adjustment plates and adjusters could be utilized, in the embodiment depicted adjustment plate 8 is in the general form of a disc 11 that is secured to bracket member 7 by means of a plurality of fasteners 12. One of ordinary skill will also appreciate that such adjustment plates are known in the art and that their position relative to bracket member 7 can be adjusted by a blind installer. Altering the position of the adjustment plate relative to bracket member 7 is typically accommodated by the receipt of fasteners 12 through slots 13 in the adjustment plate that permit the adjustment plate to be slid in the direction of the longitudinal axis of slots 13.

As shown, bracket member 7 may include a mounting flange 14 to permit the bracket member to be mounted to a surface (for example a wall or window frame). Bracket member 7 further includes an interior face 15 to which adjustment plate 8 is secured. Adjuster 9 permits the slidable movement of adjustment plate 8 along interior face 15 of bracket member 7.

In accordance with an embodiment of the invention, shield 10 is secured to (or integrally formed with) adjustment plate 8 such that it is movable with the adjustment plate. That is, as the adjustment plate is slidably adjusted about interior face 15 of bracket member 7, so is shield 10. Shield 10 includes an interior side surface 16 that is offset from adjustment plate 8 in a direction toward roller tube 4. From a thorough understanding of the invention it will be understood that shield 10, and in particular interior side surface 16, prevents contact between adjuster 9 and blind fabric 5 received about roller tube 4.

In one embodiment of the invention, shield 10 includes a bore 17 for releasably receiving the roller tube shaft of roller tube 4. Bore 17 may include a bushing or bearing 18 to help reduce frictional contact between the shield and the roller tube shaft. Further, the interior side surface 16 of shield 10 may include a friction reducing coating (which may be paint, a plasticized coating, a friction reducing decal or outer layer, etc.) in order to further help prevent damage to blind fabric 5 in the event that the blind fabric should come into contact with interior side surface 16.

As shown in FIGS. 2 through 5, bracket member 7 and shield 10 may include co-operating flanges 19 and 20. Flange 19 comprises a first flange secured to or formed with bracket member 7, and flange 20 comprises a second flange formed with or secured to shield 10. Flanges 19 and 20 are preferably generally parallel to one another. In the particular embodiment shown, first flange 19 includes a threaded bore for receiving a threaded bolt 21. Flanges 19 and 20, together with threaded bolt 21, comprise adjuster 9. Threading bolt 21 into the threaded bore on first flange 19 causes the interior end 22 of bolt 21 to contact second flange 20 such that threading the bolt into or out of first flange 19 results in a sliding movement of adjuster plate 8 about the interior face 15 of bracket member 7. Second flange 20 extends inwardly from inner side face 16 of shield 10 toward the interior face 15 of bracket member 7. Threaded bolt 21 and first flange 19 do not extend outwardly from adjuster plate 8 (toward roller tube 4) to an extent that they would project beyond interior side surface 16 of shield 10.

It will therefore be understood that through the incorporation of an adjustable mounting bracket constructed in accordance with the described embodiments of the invention, damage to blind fabric wound about the roller tube will be minimized or eliminated, particularly in instances where the blind fabric telescopes about the roller tube. In some instances, despite good intentions and care on the part of installers, roller tubes are not mounted perfectly horizontal. In other instances, wear on components of the roller blind over time can cause the roller tube to become slightly out of horizontal. If the roller tube were non-horizontal when blind fabric is returned to the roller tube it may have a tendency to "telescope" longitudinally along the length of the tube and come into close proximity, or in some cases contact, with components of mounting bracket 2. In situations where shield 10 is not utilized, telescoping blind fabric could contact portions of adjuster 9 (including threaded bolt 21) which is likely to cause damage to the edges of the blind fabric. Through the incorporation of shield 10, contact between blind fabric 5 and mounting bracket 2 is substantially limited to only interior side surface 16 of shield 10 which, as noted above, has a tendency to help minimize damage to the blind fabric.

It is to be understood that what has been described are the preferred embodiments of the invention. The scope of the claims should not be limited by the preferred embodiments set forth above, but should be given the broadest interpretation consistent with the description as a whole.

I claim:

1. An adjustable roller blind mounting bracket comprising:

a bracket member adapted for mounting to a surface, said bracket member having an interior face;

an adjustment plate slidably received upon said interior face of said bracket member, said adjustment plate releasably receiving and supporting a roller tube shaft of a roller tube of the roller blind;

an adjuster to alter the position of said adjustment plate relative to said bracket member; and a shield secured to said adjustment plate and moveable therewith, said shield having an interior side surface offset from said adjustment plate and preventing contact between said adjuster and blind fabric received about the roller tube;

said bracket member and said shield having co-operating flanges comprising a first flange on said bracket member, and a second flange on said shield, said first flange including a threaded bore for receiving a threaded bolt, and said shield preventing contact between said first flange and said threaded bolt.

2. The mounting bracket as claimed in claim 1 wherein said co-operating flanges and said threaded bolt together comprising said adjuster.

3. The mounting bracket as claimed in claim 2 wherein said shield includes a bore or opening for releasably receiving the roller tube shaft of the roller tube.

4. The mounting bracket as claimed in claim 3 wherein said shield includes a friction reducing coating on said interior side surface.

* * * * *